US005796244A

United States Patent [19]

Chen et al.

[11] Patent Number: 5,796,244

[45] Date of Patent: Aug. 18, 1998

[54] BANDGAP REFERENCE CIRCUIT

[75] Inventors: Yun Sheng Chen, Tainan Hsian; Ming-Zen Lin, Hsinchu, both of Taiwan

[73] Assignee: Vanguard International Semiconductor Corporation, Hsin-Chu, Taiwan

[21] Appl. No.: 893,641

[22] Filed: Jul. 11, 1997

[51] Int. Cl.[6] ..... G05F 3/16

[52] U.S. Cl. ..... 323/313; 323/907; 327/539

[58] Field of Search ..... 323/313, 314, 323/907; 327/513, 539

[56] References Cited

U.S. PATENT DOCUMENTS

| | | | |
|---|---|---|---|
| 4,317,054 | 2/1982 | Caruso et al. | 307/297 |
| 4,375,595 | 3/1983 | Ulmer et al. | 307/297 |
| 4,588,941 | 5/1986 | Kerth et al. | 323/314 |
| 4,628,248 | 12/1986 | Birrittella et al. | 323/314 |
| 5,053,640 | 10/1991 | Yum | 307/296.6 |
| 5,187,395 | 2/1993 | Pirez | 307/491 |
| 5,451,860 | 9/1995 | Khayat | 323/314 |
| 5,592,123 | 1/1997 | Ulbrich | 330/288 |
| 5,612,613 | 3/1997 | Dutt et al. | 323/314 |

*Primary Examiner*—Adolf Berhane
*Attorney, Agent, or Firm*—George O. Saile; Stephen B. Ackerman; Bill Knowles

[57] ABSTRACT

A voltage reference circuit that will remain constant and independent of changes in the operating temperature that is correlated to the bandgap voltage of silicon is described. The voltage reference circuit will be incorporated within an integrated circuit and will minimize currents into the substrate. The bandgap voltage reference circuit has a bandgap voltage referenced generator that will generate a first referencing voltage having a first temperature coefficient, and a compensating voltage generator that will generate a second referencing voltage having a second temperature coefficient. The second temperature coefficient is approximately equal and of opposite sign to the first temperature coefficient. A voltage summing circuit will sum the first referencing voltage and the second referencing voltage to create the temperature independent voltage. A voltage biasing circuit will couple a bias voltage to the bandgap voltage referenced generating means to bias the bandgap voltage referenced generator to generate the first referencing voltage. The voltage biasing circuit has a first MOSFET configured as first diode having an anode coupled to the power supply voltage source, and a second MOSFET configured as second diode having an anode coupled to the source of the first MOSFET and a cathode coupled to the ground reference point. The biasing voltage is developed at the connection of the cathode of the first diode and the anode of the second diode and said biasing voltage has a value a voltage drop across said second diode.

13 Claims, 5 Drawing Sheets

FIG. 1 – Prior Art

FIG. 2 – Prior Art

BANDGAP REFERENCE CIRCUIT

BACKGROUND OF THE INVENTION

1. Field of the Invention

This invention relates to voltage reference circuits that provide a stable voltage source that will not vary as operating temperature varies for use within integrated circuits such as dynamic random access memories (DRAM) and more particularly to voltage reference circuits correlated to the bandgap of silicon.

2. Description of Related Art

The design of a bandgap referenced voltage source circuits is well known in the art. These circuits are designed to provide a voltage reference that is independent of changes in temperature of the circuit.

The voltage reference is a function of the voltage developed between the base and emitter $V_{be}$ of a one bipolar junction transistor (BJT) and the difference between the $V_{be}$'s of two other BJT's (ΔVbe). The $V_{be}$ of the first BJT has a negative temperature coefficient or the change in the $V_{be}$ will be decrease as the temperature increases. The $\Delta V_{be}$ of the two other BJT's will have a positive temperature coefficient, which means that the $\Delta V_{be}$ will increase as the temperature increases.

The temperature independent voltage reference is adjusted by scaling the $\Delta V_{be}$ and summing it with the $V_{be}$ of the first BJT.

Referring now to FIG. 1 to understand an implementation of a voltage reference circuit of prior art. The $V_{be}$ generator consists of the PNP BJT $Q_{133}$ and the resistor $R_{136}$. The voltage $V_{ref}$ will be determined by the voltage drop across the resistor $R_{136}$ added to the $V_{be}$ of the PNP BJT $Q_{133}$.

The bandgap voltage generator will create the $\Delta V_{be}$ that will be added to the $V_{be}$ of the PNP BJT $Q_{133}$. The summing circuit is formed by the P-channel metal oxide semiconductor transistor (PMOST) $P_{130}$ The PMOST $P_{130}$ has its source connected to the power supply voltage source $V_{cc}$, its gate connected to the bandgap voltage generator. The current $I_{130}$ through the PMOST $P_{130}$ is determined by the voltage present at the gate which will be $$V_{bg}=KV_T \quad \text{eq. 1}$$

where:

$V_{bg}$ is the voltage present at the output of the bandgap generator.

K is a scaling factor whose derivation will be discussed presently.

$$V_T = kT/q$$

or the voltage equivalent of temperature
where:

k is Boltzman's constant

T is temperature q is the charge of an electron

The current $I_{130}$ through the PMOST $P_{130}$ will therefore be dependent upon the value of $V_T$ which will have a positive temperature coefficient. The Vbe of the PNP BJT $Q_{133}$ will have a negative temperature coefficient that is approximately −2 mV/°C..

The bandgap generator uses the difference in the base emitter voltages $V_{be}$ of the PNP BJT's $Q_{135}$ and $Q_{134}$ to develop the output put voltage of the bandgap generator. To determine this difference, the collector currents for each of the PNP BJT's $Q_{135}$ and $Q_{134}$ is determined as:

$$I_{cQ135} = A_{Q135} I_s e V_{beQ135}/V_T \quad \text{eq. 2}$$

$$I_{cQ134} = A_{Q134} I_s e V_{beQ134}/V_T \quad \text{eq. 3}$$

where:

$I_{cQ135}$ is the collector current of the PNP BJT $Q_{135}$.

$I_{cQ134}$ is the collector current of the PNP BJT $Q_{134}$.

$A_{Q135}$ is the area of the base emitter junction of the PNP BJT $Q_{135}$.

$A_{Q134}$ is the area of the base emitter junction of the PNP BJT $Q_{134}$.

$V_{beQ135}$ is the $V_{be}$ for the PNP BJT $Q_{135}$.

$V_{beQ134}$ is the $V_{be}$ for the PNP BJT $Q_{134}$.

$$V_T = kT/q$$

or the voltage equivalent of temperature
where:

k is Boltzman's constant

T is temperature q is the charge of an electron

The current sources $I_{144}$, $I_{141}$, $I_{132}$, $I_{149}$, $I_{146}$, and $I_{131}$, are structured by current mirrors such that the currents through each of the current sources are equal. The PNP BJT's $Q_{143}$, $Q_{142}$, and $Q_{135}$, have identical structures such that the $V_{be}$'s of the PNP BJT's $Q_{143}$, $Q_{142}$, and $Q_{135}$ are all equal. Additionally, the PNP BJT's $Q_{148}$, $Q_{147}$, and $Q_{134}$, have identical structures such that the $V_{be}$'s of the PNP BJT's $Q_{148}$, $Q_{147}$, and $Q_{134}$ are also all equal.

The voltages at the inputs $n_1$ and $p_1$ of the operational amplifier will be such that they are virtually equal thus the difference in the $V_{be}$'s of the PNP BJT's $Q_{135}$ and $Q_{134}$ will be developed across the resistor $R_{137}$. This can be shown as:

$$V_{n_1}=V_{p1}. \quad \text{eq. 4}$$

$$V_{p1}=I_{132}\times R_{137}+V_{beQ135}+V_{beQ142}+V_{beQ143}. \quad \text{eq. 5}$$

$$V_{n_1}=V_{beQ134}+V_{be147}+V_{beQ148}. \quad \text{eq. 6}$$

Since $$V_{beQ135}=V_{beQ142}=V_{beQ143}$$

and $$V_{beQ134}=V_{beQ147}=V_{beQ148}$$

then $$3V_{beQ134}=I_{132}\times R_{137}+3V_{beQ135}. \quad \text{eq. 7}$$

And since the current sources $I_{144}$, $I_{141}$, $I_{132}$, $I_{149}$, $I_{146}$, and $I_{131}$ are all equal in magnitudes and essentially equal to the collector currents of the PNP BJT's $Q_{135}$ and $Q_{134}$, then:

$$I_{cQ134}=I_{cQ135}. \quad \text{eq. 8}$$

Substituting and rearranging equations 2 and 3 it can be shown that $$V_{beQ134}=V_{beQ135}-V_T lnA \quad \text{eq. 9}$$

where $$A\left(\frac{A_{Q135}}{A_{Q134}}\right).$$

and since $I_{cQ_{135}}$ is equal to the current source $I_{132}$ then substituting equation 9 into equation 7, the result is:

$$I_{132}=\frac{3V_T lnA}{R_{137}} \quad \text{eq. 10}$$

The voltage at the output of the operational amplifier will be such that the current $I_{130}$ through the PMOST $P_{130}$ will mirror the current $I_{132}$ or $$I_{130}=NxI_{132}. \quad \text{eq. 11}$$

Thus setting the voltage reference $V_{ref}$ to:

$$V_{ref}=V_{beQ_{133}}+I_{130}xR_{136} \quad \text{eq. 12}$$

which becomes $$V_{ref}=V_{beQ_{133}}+\frac{(Nx3xlnA)xV_T}{R_{137}}\ xV_{136}. \quad \text{eq. 13}$$

The scaling factor K from equation 1 will be described as:

$$K\frac{(Nx3xlnA)R_{136}}{R_{137}} \quad \text{eq. 14}$$

As described above the $V_{be}$ of the PNP BJT $Q_{133}$ has a negative temperature coefficient and the "voltage equivalent of temperature" $V_T$ has a positive temperature coefficient. By appropriate adjustment of the scaling factor of the area of the PNP BJT's $Q_{134}$ and $Q_{135}$ and the resistances of the resistors $R_{137}$ and $R_{136}$, the voltage $V_{ref}$ can be made temperature independent.

Referring now to FIG. 2, the current sources $I_{144}$, $I_{141}$, $I_{132}$, $I_{149}$, $I_{146}$, and $I_{131}$ can be implemented respectively by the PMOST's $P_{197}$, $P_{196}$, $P_{195}$, $P_{194}$, $P_{193}$, and $P_{192}$. The sources of the PMOST's $P_{197}$, $P_{196}$, $P_{195}$, $P_{194}$, $P_{193}$, and $P_{192}$ are connected to the power supply voltage source $V_{cc}$ and the gates are connected to the output of the operational amplifier. The drains of the PMOST's $P_{197}$, $P_{196}$, $P_{194}$, $P_{193}$, and $P_{192}$ are respectively connected to the PNP BJT's $Q_{143}$, $Q_{142}$, $Q_{148}$, $Q_{147}$, and $Q_{134}$. The drain of the PMOST $P_{195}$ is connected to the resistor $R_{137}$.

If this structure is used in integrated circuits having a substrate connected to a negative substrate biasing voltage source $V_{bb}$, the current from all the current sources $P_{197}$, $P_{196}$, $P_{195}$, $P_{194}$, $P_{193}$, and $P_{192}$ passes to the negative substrate biasing voltage source $V_{bb}$. In integrated circuits such as DRAM's which have an active mode and a standby mode when the power is reduced, the currents from the current sources formed by the PMOST's $P_{197}$, $P_{196}$, $P_{195}$, $P_{194}$, $P_{193}$, and $P_{192}$ can be excessive. The PNP BJT's $Q_{143}$, $Q_{142}$, $Q_{148}$, and $Q_{147}$ as well as the PMOST's $P_{197}$, $P_{196}$, $P_{194}$, and $P_{193}$, will have to have relatively large geometries and occupy a large amount of area within the integrated circuit. Additionally the PNP BJT's $Q_{133}$, $Q_{134}$, $Q_{135}$, $Q_{143}$, $Q_{142}$, $Q_{148}$, and $Q_{147}$ can be implemented easily within standard CMOS processing without special processing steps being added.

U.S. Pat. No. 5,451,860 (Khayat) teaches a bandgap reference voltage circuit adapted for low current applications. The bandgap reference is determined by the ratio of the $V_{be}$'s of a pair of BJT's and scaled by a ratio of resistances of a pair of MOS transistors.

U.S. Pat. No. 5,053,640 (Yum) describes a bandgap reference voltage circuit. The bandgap reference circuit provides a two or three transistor reference cell and a resistor divider network to scale to the output reference voltage. A temperature compensated reference voltage modulates the voltage within the resistor divider network to compensate for variations due to changes in temperature.

SUMMARY OF THE INVENTION

An object of this invention is to provide a voltage reference circuit that will remain constant and independent of changes in the operating temperature.

Another object of this invention is to provide a voltage reference circuit within an integrated circuit that will minimize currents into a substrate.

Further another object of this invention is to provide a voltage reference circuit that does not require special integrated circuit processing steps.

To accomplish these and other object a bandgap voltage reference circuit has a bandgap voltage referenced generator that will generate a first referencing voltage having a first temperature coefficient, and a compensating voltage generator that will generate a second referencing voltage having a second temperature coefficient. The second temperature coefficient is approximately equal and of opposite sign to the first temperature coefficient. A voltage summing means will sum the first referencing voltage and the second referencing voltage to create the temperature independent voltage.

A voltage biasing circuit will couple a bias voltage to the bandgap voltage referenced generating means to bias the bandgap voltage referenced generator to generate the first referencing voltage. The voltage biasing circuit has a first MOSFET configured as first diode having an anode coupled to the power supply voltage source, and a second MOSFET configured as second diode having an anode coupled to the source of the first MOSFET and a cathode coupled to the ground reference point. The biasing voltage is developed at the connection of the cathode of the first diode and the anode of the second diode and the biasing voltage has a value a voltage drop across the second diode.

DETAILED DESCRIPTION OF THE INVENTION

Figure 1:
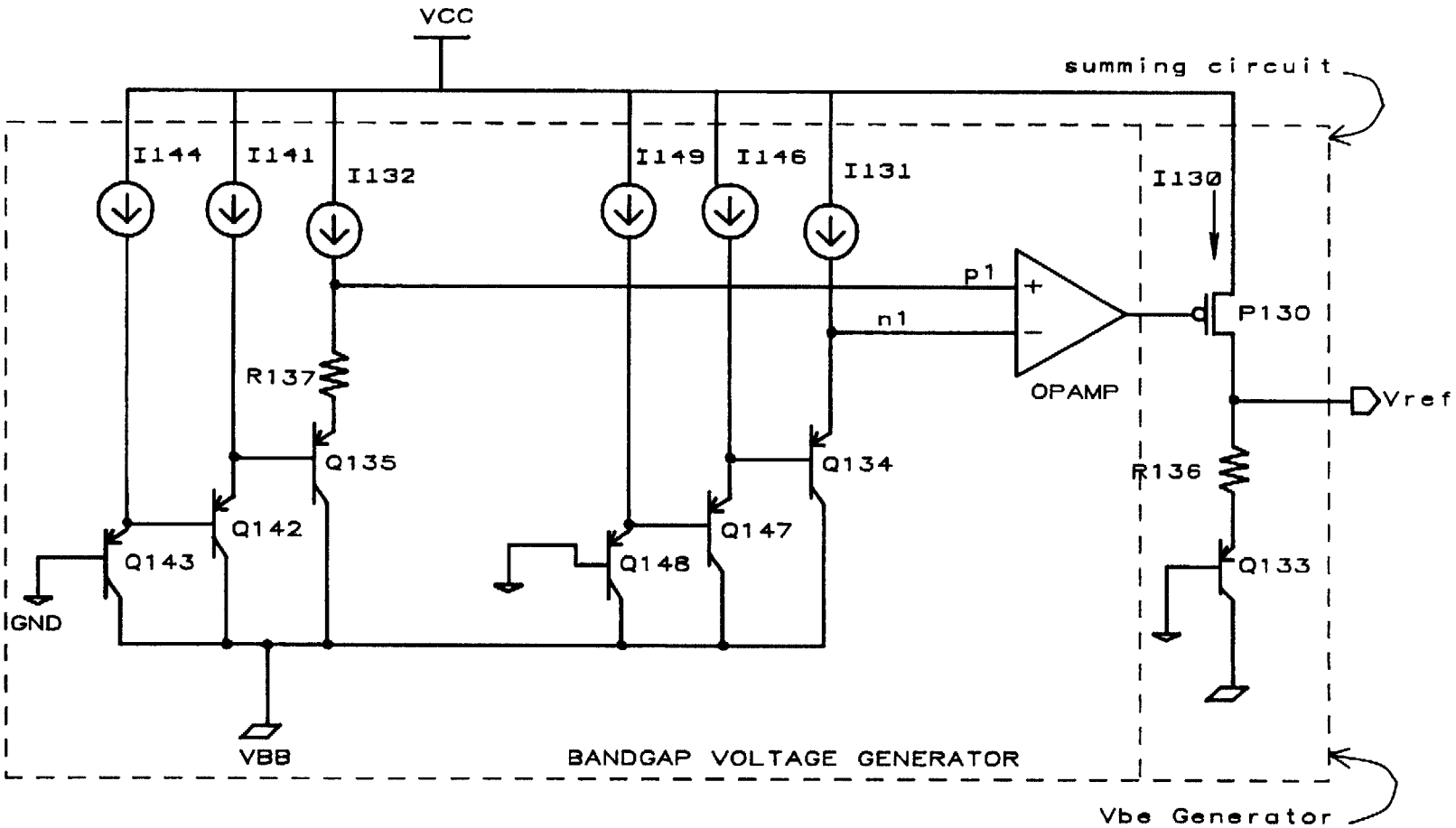
FIG. 1 is a schematic drawing of a bandgap reference circuit of the prior art.
Figure 2:
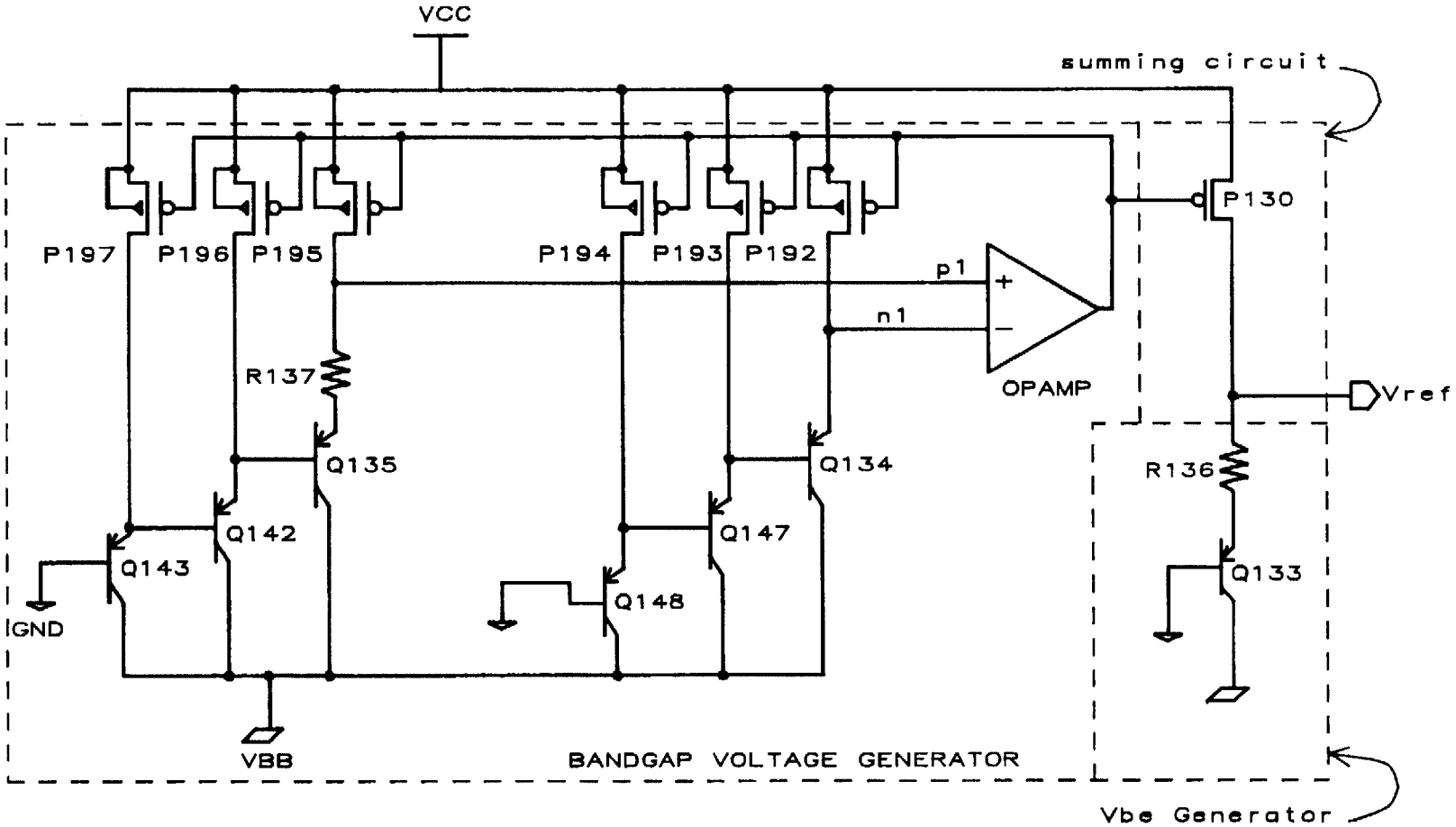
FIG. 2 is a schematic drawing of an embodiment bandgap reference circuit of the prior art.
Figure 3:
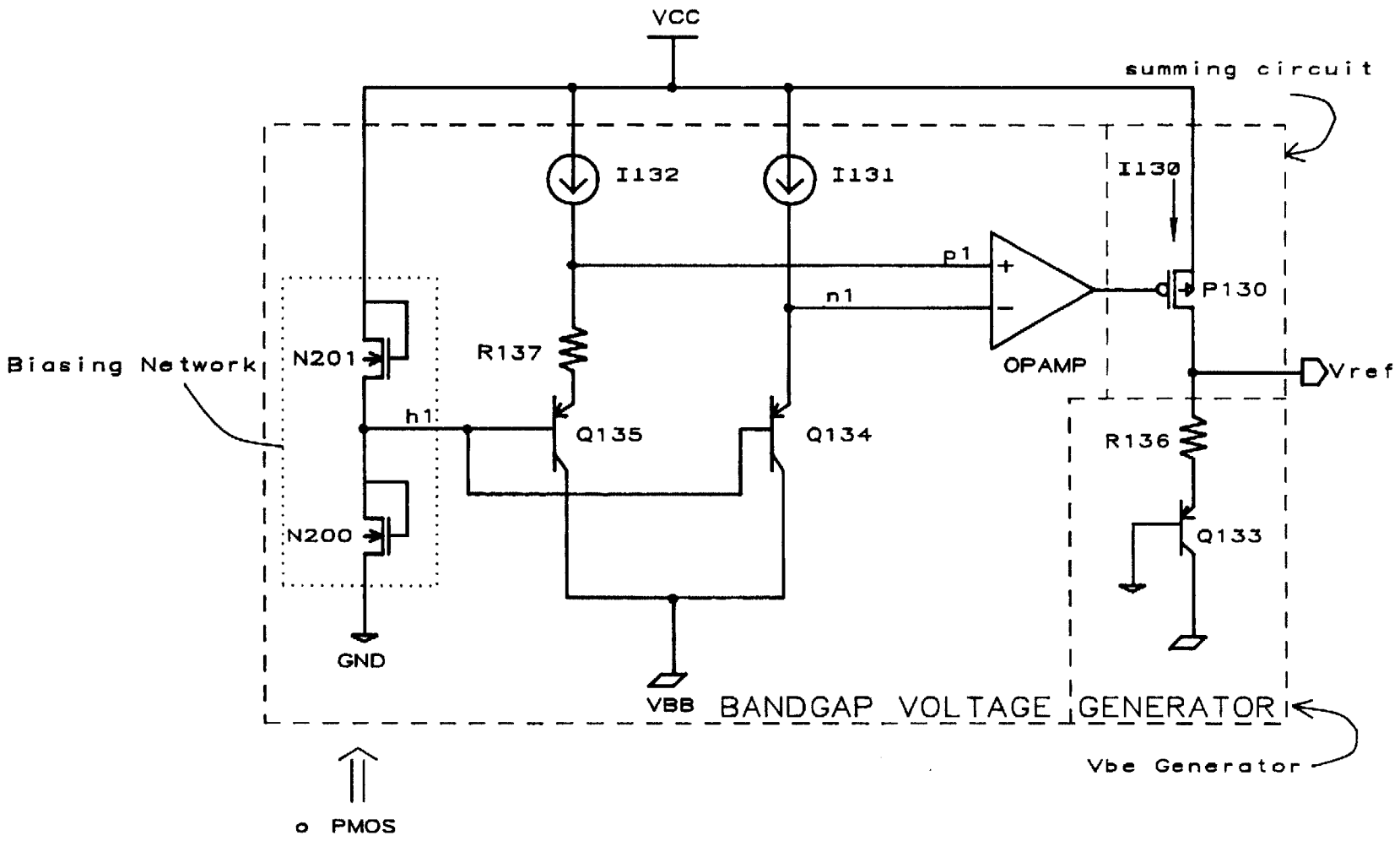
FIG. 3 is a schematic drawing of a bandgap reference circuit of this invention.
Figure 4:
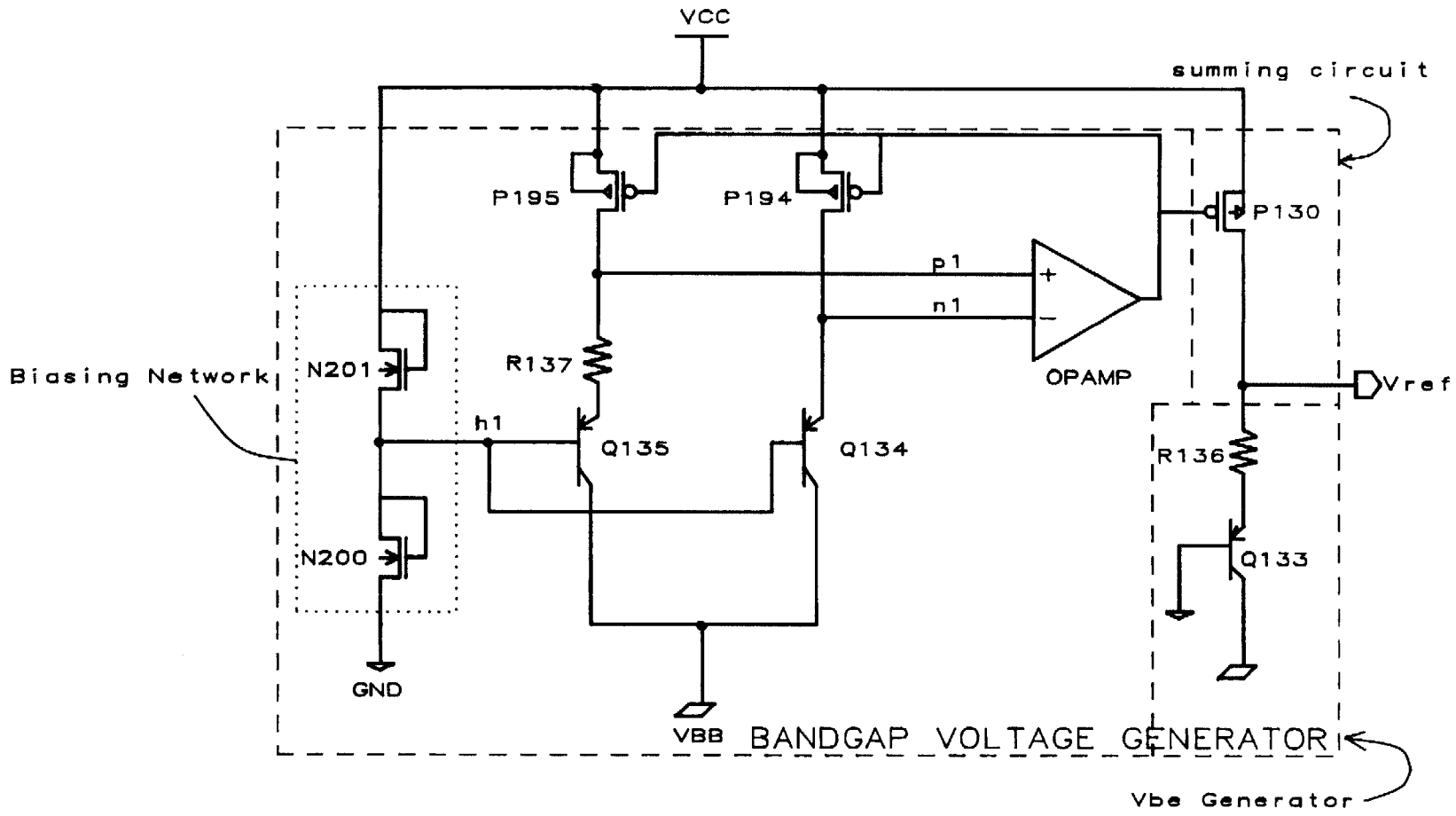
FIG. 4 is a drawing of a bandgap reference circuit of this invention.

The biasing voltage created by the PNP BJT's $Q_{143}$, $Q_{142}$, $Q_{148}$, and $Q_{147}$ and by the current sources $I_{144}$, $I_{141}$, $I_{149}$, and $I_{146}$, of FIG. 1 as implemented by the PMOST's $P_{197}$, $P_{196}$, $P_{194}$, and $P_{193}$ of FIG. 2 will now be created by the biasing network of FIGS. 3 and 4.

Referring now to FIGS. 3 and 4, the biasing network consists of the N-channel metal oxide semiconductor transistors (NMOST's) $N_{200}$ and $N_{201}$. The gate and drain of the NMOST $N_{201}$ are connected to the power supply voltage source $V_{cc}$. The source of the NMOST $N_{201}$ is connected to the gate and drain of the NMOST $N_{200}$. The source of the $N_{200}$ is connected to the ground reference point GND.

These connections form diodes with the anode of the diode formed by the NMOST $N_{201}$ connected to the power supply voltage source $V_{cc}$ and the cathode of the diode formed by the NMOST $N_{201}$ is connected to the anode of the diode formed by the NMOST $N_{200}$. The cathode of the diode formed by the NMOST $N_{201}$ is connected to the ground reference point GND.

The configuration effectively forms a voltage divider between the power supply voltage source $V_{cc}$ and the ground reference point GND. The voltage drop across an NMOST configured as a diode is given by:

$$V_d = V_{gs} = V_{th} + \sqrt{\frac{I_{Dsat}}{K'w/l}} \quad \text{eq. 15}$$

where:

$V_d$ is the voltage drop across the diode.

$V_{gs}$ is the voltage developed between the gate and source of the NMOST $N_{200}$ and $N_{201}$.

$I_{dsat}$ is the saturation current flowing from the source to the drain of the NMOST's $N_{200}$ and $N_{201}$.

K' is the process dependent saturation parameter for the NMOST's $N_{200}$ and $N_{201}$.

w/l is the gate width to gate length ratio for the NMOST's $N_{200}$ and $N_{201}$.

As can be seen from the above, the voltage developed across the diodes $N_{200}$ and $N_{201}$ can be adjusted through appropriate design of the process parameters and the device geometries.

Figure 5:
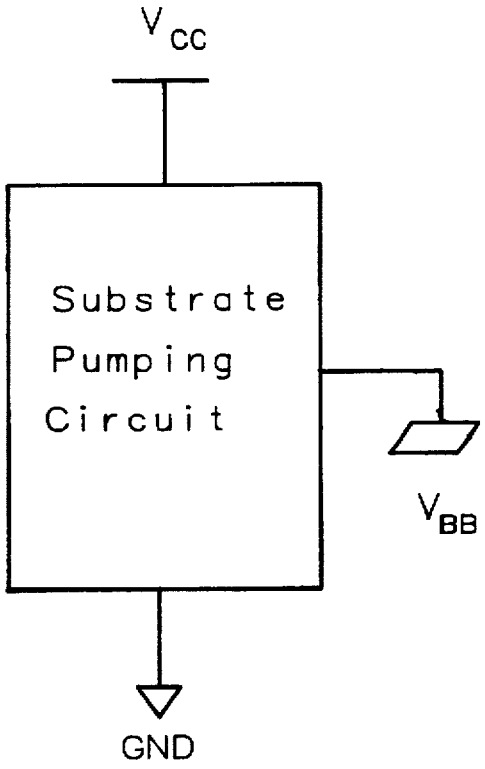
FIG. 5 is a drawing of a bandgap reference circuit of this invention.

Referring now to FIG. 5, a substrate pumping circuit will develop a substrate voltage $V_{BB}$ for the power supply voltage source $V_{cc}$ and the ground reference point GND that has a negative voltage potential relative to the ground reference point GND. If the circuit of FIG. 5 is connected to the substrate $V_{BB}$ of FIGS. 1 and 2, the current through the PNP BJT's $Q_{143}$, $Q_{142}$, $Q_{148}$, and $Q_{147}$ would be on the order of 2 μa each. This would for a total current through the substrate to the substrate pumping circuit of 8 μa to bias the PNP BJT's $Q_{134}$ and $Q_{135}$. However, if the circuit of FIG. 5 is connected to the substrate $V_{BB}$ of FIGS. 3 and 4, the biasing current will be approximately 1 μa to bias the PNP BJT's $Q_{134}$ and $Q_{135}$.

Normally this substrate bias pumping circuit has an efficiency of approximately 33%. This efficiency means that an improvement of 7 μa (8 μa of the circuit of FIGS. 1 and 2—1 μa of the circuit of FIGS. 3 and 4) will have a 21 μa improvement in the current from the power supply voltage source $V_{cc}$.

If as shown in FIG. 1, the voltage at the input $p_1$ and $n_1$ of the operation amplifier are equal now:

$$Vp_1 = I_{132} x R_{137} + V_{be_{Q135}} + V_{h1} \quad \text{eq. 16}$$

$$Vn_1 = V_{be_{Q134}} + V_{h1}. \quad \text{eq. 17}$$

Now:

$$I_{132} x R_{137} + V_{be_{Q135}} + V_{h1} = V_{be_{Q134}} + V_{h1} \quad \text{eq. 18.}$$

The voltage $V_{h1}$ will cancel from the above and the voltage shown as $V_{ref}$ will be similar to that shown in equation 13. For configuration of this invention $V_{ref}$ will be:

$$V_{ref} = V_{beQ_{133}} + \frac{(NxInA)xV_T}{R_{137}} xR_{136} \quad \text{eq. 19}$$

This configuration allows for a minimum current to be sunk by the substrate biasing voltage source $V_{bb}$, since only the current sources $I_{132}$ and $I_{131}$ will be passing to the substrate.

This structure will be able to be implemented in standard CMOS integrated circuit processing and occupy a minimum of space since the geometries of the NMOST's $N_{200}$ and $N_{201}$ will be relatively small to minimize the current in the biasing network. It will be noted by those skilled in the art that the implementation of the NMOST's can be made as PMOST's.

While this invention has been particularly shown and described with reference to the preferred embodiments thereof, it will be understood by those skilled in the art that various changes in form and details may be made without departing from the spirit and scope of the invention.

What is claimed is:

1. A reference voltage source circuit that is coupled between a power supply voltage source, a ground reference point and a substrate biasing voltage source, is incorporated within an integrated circuit, and is correlated to the bandgap of silicon to provide a temperature independent voltage while minimizing currents flowing to said substrate biasing voltage source, comprising:

a) a bandgap voltage referenced generating means to generate a first referencing voltage having a first temperature coefficient;

b) a compensating voltage generating means to generate a second referencing voltage having a second temperature coefficient, wherein the second temperature coefficient is approximately equal and of opposite sign to said first temperature coefficient;

c) a voltage summing means coupled to the bandgap voltage referenced voltage generating means and the compensating voltage generating means to sum the first referencing voltage and the second referencing voltage to create the temperature independent voltage; and d) a voltage biasing means to couple a bias voltage to the bandgap voltage referenced generating means to bias said bandgap voltage referenced generating means so as to generate the first referencing voltage.

2. The reference voltage source of claim 1 wherein said bandgap voltage referenced generating means comprises:

a) a first constant current source having a first current input terminal coupled to the power supply voltage source and a first current output terminal to transfer a first constant current;

b) a second constant current source having a second current input terminal coupled to the power supply voltage source and a second current output terminal to transfer a second constant current;

c) a first resistor having a first terminal connected to the first current output terminal, and a second terminal;

d) a first bipolar junction transistor having an emitter connected to the second terminal of the resistor, a collector connected to the substrate biasing voltage source, and a base coupled to the voltage biasing means to receive said bias voltage and wherein said first bandgap referencing voltage is developed at said emitter and the first terminal of said first resistor; and e) a second bipolar junction transistor having an emitter connected to the second current output terminal, a collector connected to the substrate bias voltage source, and a base connected to the biasing voltage means to receive said bias voltage wherein said second bandgap referencing voltage is developed at said emitter.

f) an operational amplifier having a noninverting input connected to the first terminal of the first resistor to receive the first bandgap referencing voltage, an inverting terminal connected to the emitter of the second bipolar junction transistor to receive the second bandgap referencing voltage, an amplifying means to amplify the difference between the first bandgap referencing voltage and the second bandgap referencing voltage, and an amplifier output terminal containing said difference voltage which is the difference in a voltage developed between the bases and the emitters of the first bipolar junction transistor and the second bipolar junction transistor added to the voltage developed between the first and second terminal of the first resistor.

3. The reference voltage source circuit of claim 2 wherein the first constant current source comprises a first MOSFET of a second conductivity type having a source connected to the power supply voltage source, a drain connected to the first current output terminal, and a gate connected to the amplifier output terminal, whereby said difference voltage is a bias voltage to the first MOSFET of the second conductivity type to create said first constant current.

4. The reference voltage source circuit of claim 2 wherein the second constant current source comprises a second MOSFET of a second conductivity type having a source connected to the power supply voltage source, a drain connected to the second current output terminal, and a gate connected to the amplifier output terminal, whereby said difference voltage is a bias voltage to the second MOSFET of the second conductivity type to create said second constant current.

5. The reference voltage source circuit of claim 1 wherein said voltage biasing means comprises:

a) a first MOSFET of a first conductivity type having a gate and a drain coupled to the power supply voltage source and a source, whereby said first MOSFET of the first conductivity type is configured as first diode having an anode coupled to the power supply voltage source; and b) a second MOSFET of a first conductivity type having a gate and a drain coupled to the source of the first MOSFET of the conductivity type and a source coupled to the ground reference point, whereby said second MOSFET of the first conductivity type is configured as second diode having an anode coupled to the source of the first MOSFET of the first conductivity type and a cathode coupled to the ground reference point.

6. The reference voltage source circuit of claim 5 wherein the biasing voltage is developed at the connection of the cathode of the first diode and the anode of the second diode and said biasing voltage has a value a voltage drop across said second diode.

7. The reference voltage source circuit of claim 1 wherein the voltage summing means comprises:

a third MOSFET of the second conductivity type having a source connected to the power supply voltage source, a gate connected to the amplifier output terminal to receive the difference voltage, and a drain connected to external circuitry to provide said temperature independent voltage.

8. The reference voltage source circuit of claim 1 wherein the compensating voltage means comprises:

a) a third bipolar junction transistor having a collector connected to the substrate bias voltage source, a base connected to the ground reference point, and an emitter; and b) a second resistor connected between the drain of the third MOSFET of the second conductivity type and the emitter of the third bipolar junction transistor, whereby a current generated in the voltage summing means causes a voltage to be developed across said second resistor and said temperature independent voltage is the sum of said voltage developed across said second resistor summed with the voltage developed between the base and the emitter of said third bipolar junction transistor.

9. A reference voltage source circuit that is coupled between a power supply voltage source, a ground reference point and a substrate biasing voltage source, is incorporated within an integrated circuit, and is correlated to the bandgap of silicon to provide a temperature independent voltage to a voltage reference terminal while minimizing currents flowing to said substrate biasing voltage source, comprising:

a) a bandgap voltage referenced generating means to generate a first referencing voltage having a first temperature coefficient wherein said bandgap voltage referenced generating means comprises:

a first constant current source having a first current input terminal coupled to the power supply voltage source and a first current output terminal to transfer a first constant current, a second constant current source having a second current input terminal coupled to the power supply voltage source and a second current output terminal to transfer a second constant current, a first resistor having a first terminal connected to the first current output terminal, and a second terminal, a first bipolar junction transistor having an emitter connected to the second terminal of the resistor, a collector connected to the substrate biasing voltage source, and a base coupled to the voltage biasing means to receive said bias voltage and wherein said first bandgap referencing voltage is developed at said emitter added to a voltage developed between the first and second terminal of said first resistor, a second bipolar junction transistor having an emitter connected to the second current output terminal, a collector connected to the substrate bias voltage source, and a base connected to the biasing voltage means to receive said bias voltage wherein said second bandgap referencing voltage is developed at said emitter, and an operational amplifier having a noninverting input connected to the first terminal of the first resistor to receive the first bandgap referencing voltage, an inverting terminal connected to the emitter of the second bipolar junction transistor to receive the second bandgap referencing voltage, an amplifying means to amplify the difference between the first bandgap referencing voltage and the second bandgap referencing voltage, and an amplifier output terminal containing said difference voltage which is the difference in a voltage developed between the bases and the emitters of the first bipolar junction transistor and the second bipolar junction transistor added to the voltage developed between the first and second terminal of said first resistor;

b) a compensating voltage generating means to generate a second referencing voltage having a second temperature coefficient, wherein the second temperature coefficient is approximately equal and of opposite sign to said first temperature coefficient, wherein the compensating voltage means comprises:

a third bipolar junction transistor having a collector connected to the substrate bias voltage source, a base connected to the ground reference point, and an emitter; and a second resistor connected between the voltage reference terminal and the emitter of the third bipolar junction transistor, whereby a current causes a voltage to be developed across said second resistor and said temperature independent voltage is the sum of said voltage developed across said second resistor summed with the voltage developed between the base and the emitter of said third bipolar junction transistor;

c) a voltage summing means coupled to the bandgap voltage referenced voltage generating means and the compensating voltage generating means to sum the first referencing voltage and the second referencing voltage to create the temperature independent voltage, wherein the voltage summing means comprises:

a first MOSFET of a second conductivity type having a source connected to the power supply voltage source, a gate connected to the amplifier output terminal to receive the difference voltage, and a drain connected to second resistor to provide the current to be transferred through said second resistor; and d) a voltage biasing means to couple a bias voltage to the bandgap voltage referenced generating means to bias said bandgap voltage referenced generating means so as to generate the first referencing voltage, wherein said voltage biasing means comprises:

a first MOSFET of a first conductivity type having a gate and a drain coupled to the power supply voltage source and a source, whereby said first MOSFET of the first conductivity type is configured as first diode having an anode coupled to the power supply voltage source; and a second MOSFET of the first conductivity type having a gate and a drain coupled to the source of the first MOSFET of the conductivity type and a source coupled to the ground reference point, whereby said second MOSFET of the first conductivity type is configured as second diode having an anode coupled to the source of the first MOSFET of the first conductivity type and a cathode coupled to the ground reference point.

10. The reference voltage source circuit of claim 9 wherein the biasing voltage is developed at the connection of the cathode of the first diode and the anode of the second diode and said biasing voltage has a value a voltage drop across said second diode.

11. The reference voltage source circuit of claim 9 wherein the first constant current source comprises a second MOSFET of the second conductivity type having a source connected to the power supply voltage source, a drain connected to the first current output terminal, and a gate connected to the amplifier output terminal, whereby said difference voltage is a bias voltage to the second MOSFET of the second conductivity type to create said first constant current.

12. The reference voltage source circuit of claim 9 wherein the second constant current source comprises a third MOSFET of a second conductivity type having a source connected to the power supply voltage source, a drain connected to the second current output terminal, and a gate connected to the amplifier output terminal, whereby said difference voltage is a bias voltage to the third MOSFET of the second conductivity type to create said second constant current.

13. A bandgap reference circuit that is coupled between a power supply voltage source, a ground reference point and a substrate biasing voltage source, is incorporated within an integrated circuit, and is correlated to the bandgap of silicon to provide a temperature independent voltage to a voltage reference terminal while minimizing currents flowing to said substrate biasing voltage source, comprising:

a) a first bipolar junction transistor and a second bipolar junction transistor, wherein said temperature independent biasing voltage is a function of a difference in a voltage developed between a base and an emitter of each of the first bipolar junction transistor and the second bipolar junction transistor, and wherein a collector of each of the first and second bipolar junction transistors are connected to the substrate;

b) a first MOSFET of a first conductivity type and a second MOSFET of the first conductivity type each having a source and a drain connected together to respectively form a first diode and second diode, wherein said first and second diodes are interconnected serially between the power supply voltage source and the ground reference point whereby an interconnection point between said first and second diodes is connected to the base of each of the first and second bipolar junction transistor;

c) a first resistor having a first terminal connected to the emitter of the first bipolar junction transistor to develop the difference in the voltage developed between the base and emitter of each of the first and second bipolar junction transistors;

d) a first MOSFET of a second conductivity type and a second MOSFET of the second conductivity type, wherein the drain of the first MOSFET of the second conductivity type is connected to a second terminal of the first resistor and the drain of the second MOSFET of the second conductivity type is connected to an emitter of the second bipolar junction transistor, and wherein the first and second MOSFET's of the second conductivity type are configured to function respectively as a first and second constant current source, whereby each of the first and second constant current sources will provide an identical current to the first and second bipolar junction transistors;

e) an operational amplifier having a noninverting input connected to the second terminal of the first resistor, an inverting input connected to the emitter of the second bipolar junction transistor, and an output that provides an output voltage that is an amplified version of the difference in the voltage developed between the base and emitter of each of the first and second bipolar junction transistors, and wherein said output is connected to a gate of each of the first and second MOSFET's of the second conductivity type to control the magnitude of each of the constant currents form the first and second current sources;

f) a third MOSFET of the second conductivity type having a gate connected to the output of the operational amplifier, a source connected to the power supply voltage source, and a drain coupled to said voltage reference terminal, whereby said third MOSFET of the second conductivity type is configured to provide a third constant current from said drain;

g) a second resistor coupled to the voltage reference terminal to develop a voltage that is a function of the is the amplified version of the difference in the voltage developed between the base and emitter of each of the first and second bipolar junction transistors as a result of the third constant current; and h) a third bipolar junction transistor having an emitter connected to the second resistor, a base connected to the ground reference point and a collector connected to the substrate biasing voltage source, whereby the temperature independent voltage is the sum of the voltage developed across the second resistor and the a voltage developed between the base and the emitter of said third bipolar junction transistor.

* * * * *